US007510293B2

(12) United States Patent
Chyn

(10) Patent No.: US 7,510,293 B2
(45) Date of Patent: Mar. 31, 2009

(54) CONTACTLESSLY-CHARGEABLE LIGHT-UP SHOE

(76) Inventor: Shu-Shyong Chyn, 7F., No. 81, Jhongpu 2nd St., Taoyuan City, Taoyuan County 330 (TW)

( * ) Notice: Subject to any disclaimer, the term of this patent is extended or adjusted under 35 U.S.C. 154(b) by 0 days.

(21) Appl. No.: 11/774,630

(22) Filed: Jul. 9, 2007

(65) Prior Publication Data

US 2008/0005935 A1 Jan. 10, 2008

(30) Foreign Application Priority Data

Jul. 10, 2006 (CN) ..... 2006 2 0016938 U

(51) Int. Cl.
*F21V 21/08* (2006.01)

(52) U.S. Cl. ..... 362/103; 362/183; 362/192; 36/137

(58) Field of Classification Search ..... 362/103, 362/183, 192; 36/137
See application file for complete search history.

(56) References Cited

U.S. PATENT DOCUMENTS 5,860,727 A * 1/1999 Chien ..... 362/103
2005/0024852 A1 * 2/2005 Wong et al. ..... 362/103

* cited by examiner

*Primary Examiner*—Stephen F Husar
(74) *Attorney, Agent, or Firm*—Ming Chow; Sinorica, LLC

(57) ABSTRACT

The present invention discloses a contactlessly-chargeable light-up shoe, which comprises: a shoe, at least one rechargeable battery, and at least one light-emitting element, wherein the shoe sole has a secondary coil, a magnetic core for the secondary coil, a regulator circuit, and a switch. The secondary coil terminals are sequentially connected with the regulator circuit, the rechargeable battery, the switch and then the light-emitting elements via wires, and the abovementioned elements are airtightly encapsulated with a plastic material. The present invention has the advantages of airtightly encapsulating all the electronic elements inside a plastic material and contactlessly recharging the battery. Thereby, the present invention realizes a waterproof, dustproof and rustproof contactlessly-chargeable light-up shoe, which can flicker or emit light continuously.

1 Claim, 2 Drawing Sheets

CONTACTLESSLY-CHARGEABLE LIGHT-UP SHOE

BACKGROUND OF THE INVENTION

1. Field of the Invention

The present invention relates to a light-up shoe, particularly to a contactlessly-chargeable light-up shoe.

2. Description of the Related Art

For aesthetic feeling and kinesthetic enjoyment, kid shoes, especially sports shoes and walking shoes, are usually furnished with various light-emitting elements, such as LED (Light Emitting Diode) elements, electroluminescent elements or electric bulbs. The mobile flickering lights on feet indeed give us an amazing and amusing feeling at night. Light-emitting elements need electric energy, which may be provided by common batteries, button batteries, or rechargeable batteries. As the capacity of a common battery or button battery is limited, they need replacing often. For a waterproof purpose, electronic elements are encapsulated with a plastic material in some products. After the batteries are used up, the light-emitting function will be invalidated, and the light-up shoes thus become common shoes. In the light-up shoes adopting rechargeable batteries, the charging sockets on the shoes are exposed to water and humidity but have a poor waterproof function; thus, they are apt to short-circuit and rust, which influences the charging and light-emitting functions.

SUMMARY OF THE INVENTION

The objective of the present invention is to provide a contactlessly-chargeable light-up shoe, wherein all the electronic elements of the shoe are airtightly encapsulated inside a plastic material, and a contactless charging device is used to compensate electric energy for the rechargeable battery inside the shoe.

The contactlessly-chargeable light-up shoe of the present invention comprises: a shoe, at least one rechargeable battery, and at least one light-emitting element, wherein the shoe sole has a secondary coil, a magnetic core for the secondary coil, a regulator circuit and a switch. The secondary coil terminals are sequentially connected with the regulator circuit, the rechargeable battery, the switch and then the light-emitting elements via wires. All the abovementioned electronic elements are airtightly encapsulated inside a plastic material.

The abovementioned light-emitting elements may be LED (Light Emitting Diode) elements, electroluminescent elements or electric bulbs, and are arranged inside a transparent material on the surface of the shoe.

The contactlessly-chargeable light-up shoe of the present invention further comprises a contactless charging device that has a primary coil and a magnetic core for the primary coil, which are arranged in a pattern demolded from the abovementioned shoe sole and corresponding to the position where the second coil and the second-coil magnetic core are located. The primary coil can be connected to a commercial power via a plug. The primary coil together with the magnetic core for the primary coil provides electric energy for the secondary coil via electromagnetic induction.

In comparison with the conventional technologies, the contactlessly-chargeable light-up shoe of the present invention has the following advantages:

1. All the electronic elements of the light-up shoe are airtightly encapsulated inside a plastic material; thus, the present invention has waterproof, dustproof and rustproof functions, which can guarantee all the electronic elements to work normally.
2. The present invention utilizes a contactless charging device to compensate electric energy for the rechargeable battery inside the shoe; thus, the present invention can use the safe and reliable recharging function to provide electric energy for the light-emitting elements.

DETAILED DESCRIPTION OF THE INVENTION

Below, the present invention is further described with an embodiment.

Figure 1:
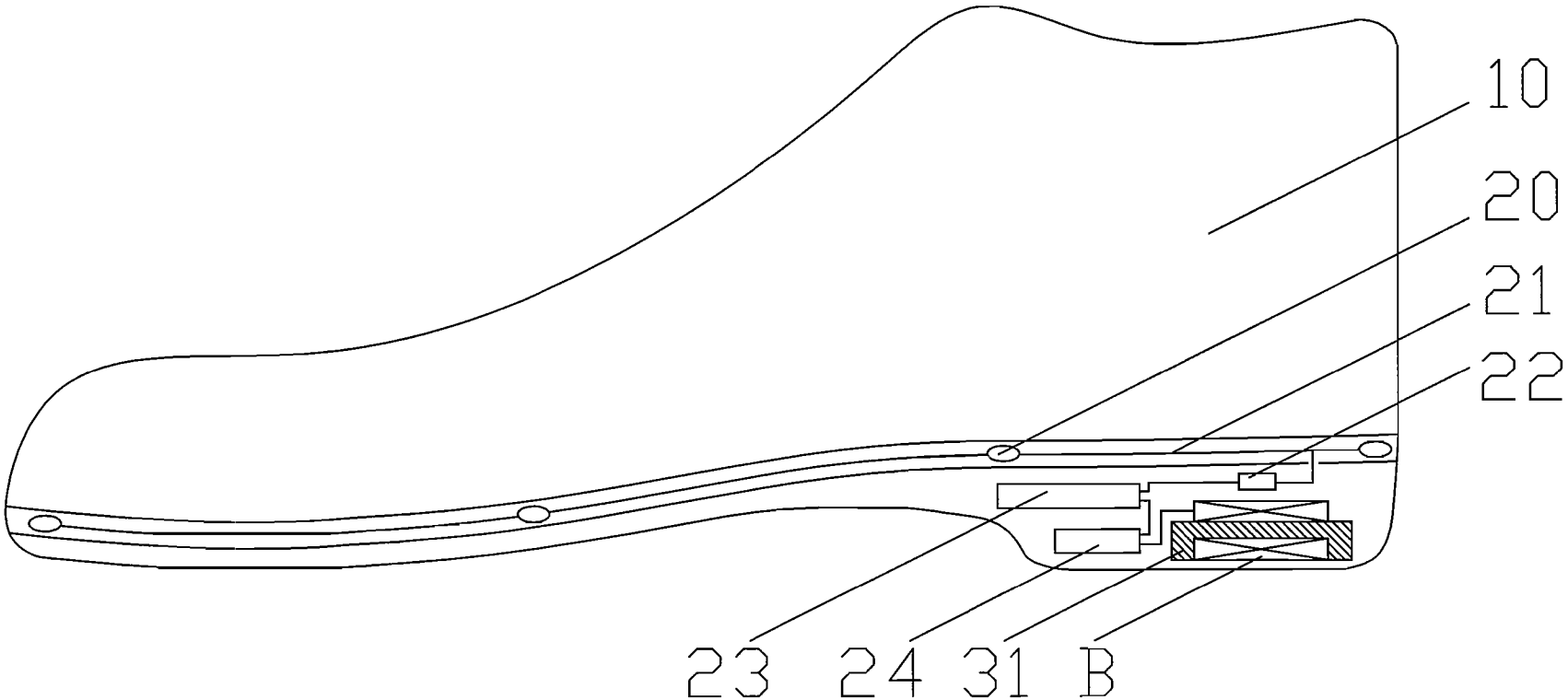
FIG. 1 is a diagram schematically showing the structure of a contactlessly-chargeable light-up shoe according to the present invention.
Figure 2:
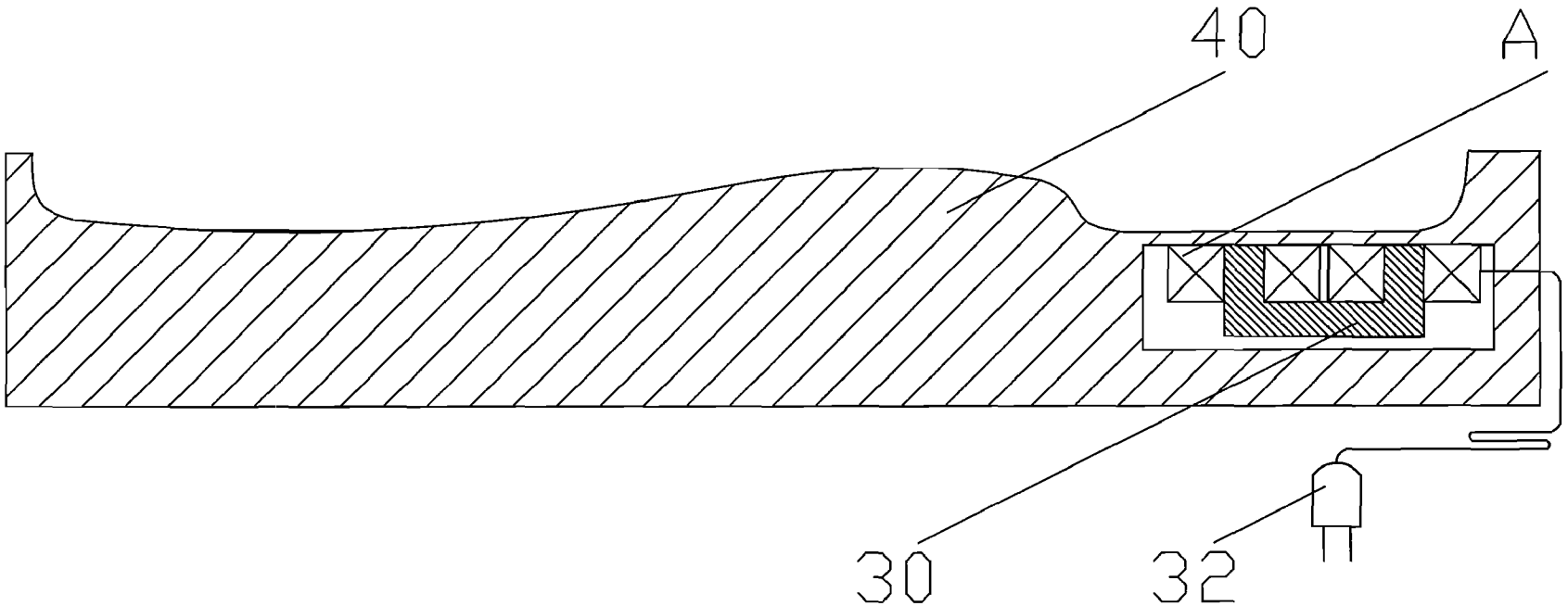
FIG. 2 is a diagram schematically showing the structure of a contactless charging device for a contactlessly-chargeable light-up shoe according to the present invention.

Refer to FIG. 1 and FIG. 2. The contactlessly-chargeable light-up shoe of the present invention comprises: a shoe 10, at least one rechargeable battery 23, and at least one light-emitting element 20, wherein the sole of the shoe 10 has a secondary coil B, a magnetic core 31 for the secondary coil B, a regulator circuit 24 and a switch 22. The terminals of the secondary coil B are sequentially connected with the regulator circuit 24, the rechargeable battery 23, the switch 22 and then the light-emitting elements 20 via wires 21. All the abovementioned electronic elements are airtightly encapsulated inside a plastic material.

The abovementioned light-emitting elements 20 may be LED (Light Emitting Diode) elements, electroluminescent elements or electric bulbs, and are arranged inside a transparent material on the surface of the shoe 10.

The contactlessly-chargeable light-up shoe of the present invention further comprises a contactless charging device that has a primary coil A and a magnetic core 30 for the primary coil A, which are arranged in a pattern 40 demolded from the abovementioned sole of the shoe 10 and corresponding to the position where the second coil B and the magnetic core 31 are located. The primary coil A can be connected to a commercial power via a plug 32. The primary coil A together with the magnetic core 30 provides electric energy for the secondary coil B via electromagnetic induction.

The usage of the present invention includes:

1. When a user wears the light-up shoes of the present invention and turns on the switch 22, the light-emitting elements will flicker or emit light continuously.
2. When a user places the light-up shoe of the present invention in the pattern 40 and connects the recharging device to a commercial power via the plug 32, the light-up shoe of the present invention will be recharged. When the recharging is completed, the plug 32 is pulled out from the socket to finish recharging.

The embodiment described above is only to exemplify the present invention but not to limit the scope of the present invention. Any equivalent modification or variation according to the shapes, structures, or principles disclosed in the present invention is to be also included within the scope of the present invention. Therefore, the scope of the present invention also includes the contactlessly-chargeable waterproof watches and contactlessly-chargeable light-up magnifiers according to the principle of the present invention.

What is claimed is:

1. A contactlessly-chargeable light-up shoe, comprising:

a shoe;

at least one rechargeable battery;

at least one light-emitting element;

a sole of the shoe wherein the sole comprises a secondary coil, a magnetic core for said secondary coil, a regulator circuit, and a switch;

terminals of said secondary coil are sequentially connected with said regulator circuit, said rechargeable battery, said switch, and then said light-emitting element via wire;

the at least one rechargeable battery, the at least one light-emitting element, the secondary coil, the magnetic core, the regulator circuit, the switch, and the terminals are airtightly encapsulated inside a plastic material;

the light-emitting element is selected from the group consisting of a LED (Light Emitting Diode) element, an electroluminescent element, and an electric bulb, wherein said light-emitting element is arranged inside a transparent material on a surface of said shoe;

a contactless charging device comprising a primary coil and a magnetic core;

the primary coil is connected to a commercial power supply via a electrical plug; and the primary coil and the magnetic core provide electric energy to the secondary coil via electromagnetic induction.

* * * * *